US005979080A

United States Patent [19]

Borsoi

[11] Patent Number: 5,979,080

[45] Date of Patent: Nov. 9, 1999

[54] LACE HAVING VARIABLE SECTIONS FOR SPORTS BOOTS AND SPORTS BOOT EQUIPPED WITH SUCH A LACE

[75] Inventor: Bruno Borsoi, Victorio Veneto, Italy

[73] Assignee: Salomon S.A., Metz-Tessy, France

[21] Appl. No.: 08/919,349

[22] Filed: Aug. 28, 1997

[30] Foreign Application Priority Data

Aug. 29, 1996 [FR] France ..... 96 10699

[51] Int. Cl.[6] ..... A43C 11/00; A43C 1/00; A43C 9/04

[52] U.S. Cl. ..... 36/50.1; 24/712; 24/715.4

[58] Field of Search ..... 36/50.1, 50.5; 24/712, 715.4

[56] References Cited

U.S. PATENT DOCUMENTS

| | | | |
|---|---|---|---|
| 584,558 | 6/1897 | McCormick | 36/50.1 |
| 709,534 | 9/1902 | Clark | 36/50.1 |
| 852,747 | 5/1907 | Thun | 24/715.4 |
| 4,538,367 | 9/1985 | Adams | 36/50 |
| 5,074,013 | 12/1991 | Arnold et al. | 24/713 |
| 5,384,971 | 1/1995 | Ferry | 36/50.1 |

FOREIGN PATENT DOCUMENTS

| | | | |
|---|---|---|---|
| 453486 | 6/1913 | France | 24/715.4 |
| 1236427 | 6/1960 | France | 24/715.1 |
| 2354723 | 1/1978 | France . | |
| 2438980 | 5/1980 | France . | |
| WO85/00959 | 3/1985 | WIPO . | |

*Primary Examiner*—M. D. Patterson
*Attorney, Agent, or Firm*—Greenblum & Bernstein P.L.C.

[57] ABSTRACT

A sports boot that includes a sole and an upper attached to the sole, the upper including a first series of return elements distributed across from each other in the frontal portion of the upper, and a second series of return elements distributed across from each other in the ascending portion of the upper, the boot including a lace that has a first portion that cooperates with the first series of return elements and two second end portions that cooperate with the second series of return elements. The first portion has a smaller section than the section of the two second end portions. The invention is also related to the lace for tightening such a boot. A fundamental objective is to provide a satisfactory solution to the problem encountered in tightening a snowboarding boot with an ascending upper.

37 Claims, 3 Drawing Sheets

112
41
42
21c
111b
111a
4
1
111
21
21d
21b
21e
21a
21f
30a
30b
110b
113
20j
20
20i
110a
20h
20e
20g
11
20f
20d
20c
40
20b
10
20a

LACE HAVING VARIABLE SECTIONS FOR SPORTS BOOTS AND SPORTS BOOT EQUIPPED WITH SUCH A LACE

BACKGROUND OF THE INVENTION

1. Field of the Invention

The present invention is related to the field of sports boots, and especially to those boots whose upper has an ascending part, such as snowboarding boots, hiking boots and other boots intended for specific sports such as hang gliding, in-line skating or others.

2. Description of Background and Relevant Information

The problem that one faces in tightening boots with ascending uppers derives from the fact that the lower portion or vamp does not require the same tightening as the ascending portion.

Indeed, the lower part generally comprises return elements of the "closed" type, such as loops, guides, eyelets, etc., that form a permanent circuit regardless of the tightening tension, as opposed to return elements of the "open" type for the ascending portion, such as hooks or others, that form a circuit capable of being released as soon as the tightening tension is relaxed sufficiently.

In a permanent type circuit, the friction on the lace is substantial in the area of the return elements. This diminishes the tightening tension in the direction of the end of the boot. The result is a tightening that is not uniform when one pulls at the ends of the lace for the first time. The tightening operation must be followed up by pulling down on those parts of the lace that are inadequately tightened. It is therefore necessary to improve tightening efficiency in this portion whilst minimizing friction, in order to obtain correct tightening, and without having to follow up on the tightening operation.

In order to do this, laces with small sections and little stretching capacity are generally used to improve the sliding, limit the friction and thus encourage tightening. But for an efficient tightening operation, enough tension must be applied on the free ends of the lace. However, the small sections tend to cause a shearing effect in the hands, and this hinders one from applying enough tension in order to efficiently tighten the frontal portion of the upper.

In addition, due to the relative lack of stretching capacity of the lace and its small section, it becomes difficult to obtain a progressive tightening in the raised portion of the upper. Thus, the distribution of the tightening pressures becomes difficult, and often the boot is too tight, thus causing discomfort, or conversely, it is too loose; and in the latter case, there is the risk that the lace will escape from the hooks, especially during bending.

As such, it can be ascertained that to date, there is no lace specifically adapted to sports boots, that enables the tightening operation of the lower part of the upper to be conducted both efficiently and homogeneously in a single movement whilst at the same time providing a good grip. Neither is any lace known that provides efficient tightening for the frontal portion of the upper along with a progressive tightening for the ascending portion of the upper.

Laces comprising portions of different types are known. For example, U.S. Pat. No. 5,074,013 is directed to a traction-resistant lace for at boot, made of a fabric, which includes two free end portions that are covered with strips made of a self-adhering material such as VELCRO. But the object of the invention of U.S. '013 is very specific. Its intention is to provide a connection that resists sliding after being tightened, and thus prevents the lace from becoming undone.

SUMMARY OF THE INVENTION

It is therefore an object of the present invention to overcome the disadvantages linked to lacing in sports boots.

More specifically, one of the objects of the invention is to provide a satisfactory solution by allowing a need based, differentiated tightening for a sports boot, and especially for boots with ascending uppers. Another object is to speed up the tightening process and avoid the problem of shearing.

These objects are achieved by selecting a lace that comprises one central portion and two end portions that are connected to the central portion; the central portion has a smaller section than the sections of the two end portions. The lacing is made all in one piece from a continuous braid of threads. Preferably, said central portion is braided more tightly than the end portions, whose braiding is looser.

Having a small section in the lacing of the central portion favors the efficiency of the tightening operation by reducing friction, whereas a larger section in the end portions reduces shearing and improves the grip during tightening and provides a more progressive tightening in this area. As such, a lace is obtained that is perfectly suited to all the requirements. The more tightened portion has less stretching capacity and less flexibility than the other portions; this enables the tightening efficiency to be improved. Conversely, the stretching capacity and flexibility of the end portions encourage grip, improve the progressive nature of the tightening, and reduce the dangers of the lace getting undone.

In addition, a lace made all in one piece can be manufactured continuously via traditional braiding means in an economical manner, and without causing resistance or other problems. The invention is also related to sports boots equipped with such a lace.

BRIEF DESCRIPTION OF THE DRAWINGS

The invention will be better understood and other characteristics thereof will become more apparent from the description that follows with reference to the annexed schematic drawings illustrating a preferred embodiment, and wherein.

DETAILED DESCRIPTION OF THE PREFERRED EMBODIMENTS

Figure 1:
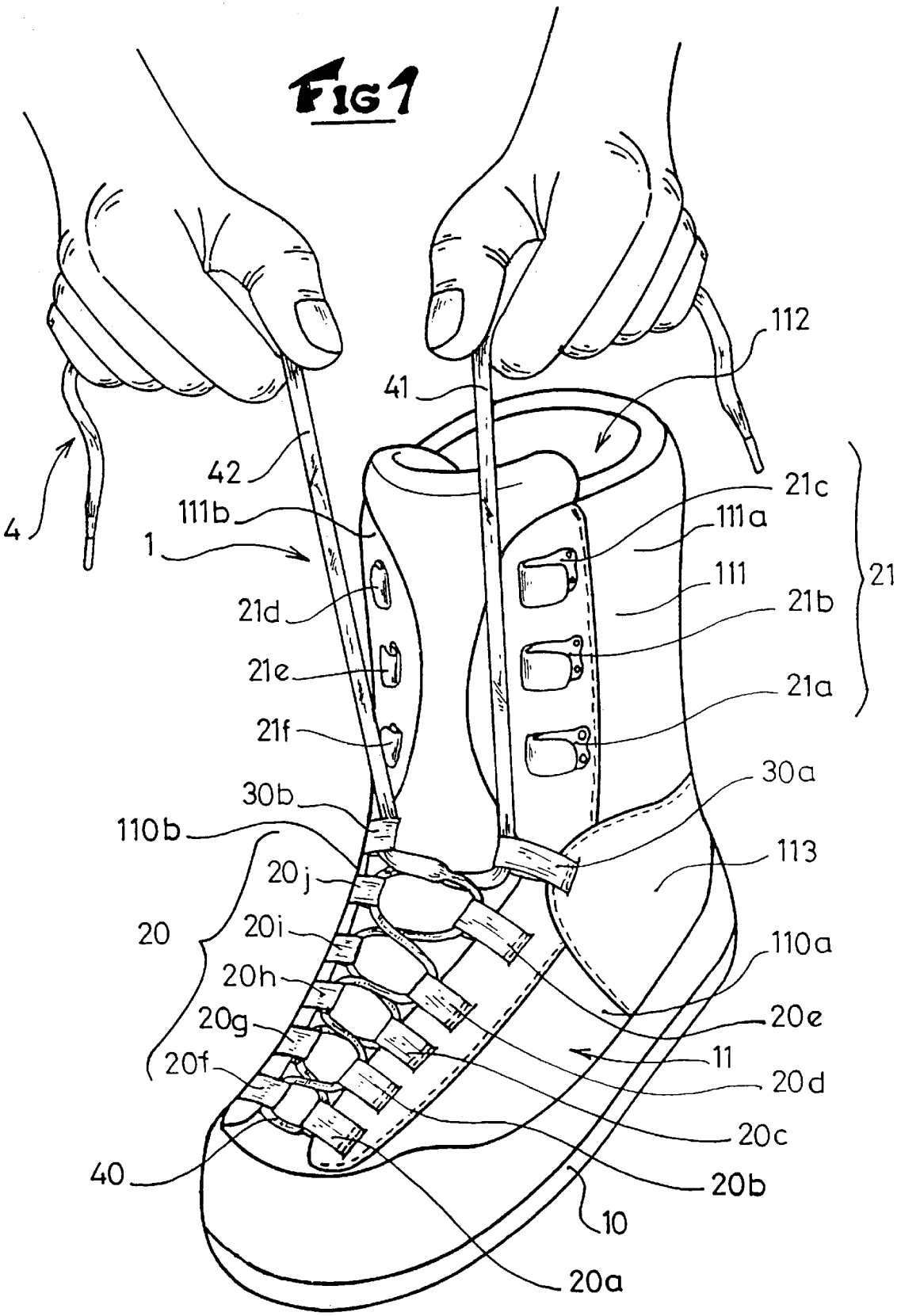
FIG. 1 is a perspective view of the front ¾ of a sports boot according to the invention at the moment when the lower portion of the upper is lightened.

With reference to FIG. 1, a shoe or boot 1 intended for the practice of snowboarding is illustrated. Such a boot must have a certain flexibility that is adapted to walking. It is intended to be connected to a glide board by a binding 26 device comprising straps whose tension can be adjusted (not represented).

The boot comprises an external walking sole 10 and a flexible upper 11 attached to the sole.

The upper 11 comprises a frontal portion or vamp 110 and an ascending portion 111 of the upper that extends the frontal portion 110 upwardly in order to cover the lower part of the leg.

The upper 11 has an opening 112 for the passage of the foot which is demarcated by two front lateral quarters 110*a*, 110*b* belonging to the frontal portion, and two upper lateral quarters 111*a*, 111*b* belonging to the ascending portion of the upper. The frontal quarters are connected to the upper quarters, but their line of demarcation cannot always be determined very specifically, and depends on the type of construction that is used for the boot.

A tongue 114 is fixed to the front end of the boot and partially covers the opening between the frontal quarters and extends between the upper quarters.

The upper 11 has a tightening device that is comprised of a first series of return elements 20 distributed across from each other on each frontal lateral quarter 110*a*, 110*b* in the frontal portion of the upper, and a second series of return elements 21 distributed across from each other on each upper lateral quarter in the ascending portion of the upper for tightening the upper and the partial closure of the opening 112.

In the example represented, the return elements of the first series 20 are constituted of closed loops 20*a*, 20*b*, 20*c*, 20*d*, 20*e*, 20*f*, 20*g*, and 20*h* that are present in the form of folded straps and whose ends are connected to the upper. Such an embodiment has the advantage of having a construction that uses minimal overthickness and is thus adapted to be inserted into a binding by the straps of a snowboard, without creating excess localized pressure or hard spots at the level of the loops. The ends of the loop attachments are, for example, stitched along the edges of each quarter 110*a*, 110*b* so that the actual loop portion spills over each quarter in order to avoid an overthickness.

The preferred return elements can be replaced by other types of closed metal loops, eyelets, etc.

The return elements of the second series are, preferably, open hooks 21*a*, 21*b*, 21*c*, 21*d*, 21*e*, 21*f* that are connected to the upper and, more specifically, to the upper quarters 111*a*, 111*b*.

Other return elements, such as the ones represented by 30*a* and 30*b* could be placed at the border between the return elements located in the frontal portion 110 and the return elements located in the upper portion 111. In this example, each element 30*a*, 30*b* is connected to a strip 113 stitched to the remainder of the structure of the upper, and their tightening improves the retention of the foot.

In order to complete the tightening device, a lace 4 according to the invention, is provided for tightening the upper 11.

The lace extends from the frontal portion 110 through to the top of the ascending portion 111 of the upper.

The lace 4 comprises a first portion or central portion 40 cooperating with the first series of return elements 20 and acts by tightening along said frontal quarters 110*a*, 110*b* and two second portions or end portions 41, 42 that cooperate with the second series of return elements 21 and act by tightening along the upper quarters 111*a*, 111*b* and end in two free end parts. According to an important characteristic of the invention, the central portion 40 has a smaller section than the section of the two end portions 41, 42.

FIG. 1 shows the tightening operation of the frontal portion 110 of the boot. The bigger section of the portions 41, 42 encourages a good grip, on the lace at the moment when a traction force is exerted on the two free ends of the lace, whereas the smaller section of the central portion 40 provides better tightening efficiency by reducing the friction in the closed loops of the series of the return elements 20.

Under normal loosening conditions of the frontal portion of the upper, i.e., when the frontal portion of the upper is in a loosened configuration, it would be preferable to ensure that the length of the central portion of lace 4 is at least equal to the connection circuit of the first series of return elements 20.

Conversely, the beginning of the end portions 41, 42 can become engaged in the return elements 30*a*, 30*b* in order to obtain a certain downward friction for the series belonging to elements 20. This is advantageous in maintaining the tightening of the frontal portion of the upper. Advantageously, the return elements 30*a*, 30*b* can be replaced by devices that block the lace which are adapted to retain the tightening tension of the frontal portion before the lacing operation and the tightening of the ascending part of the upper are undertaken.

Figure 2:
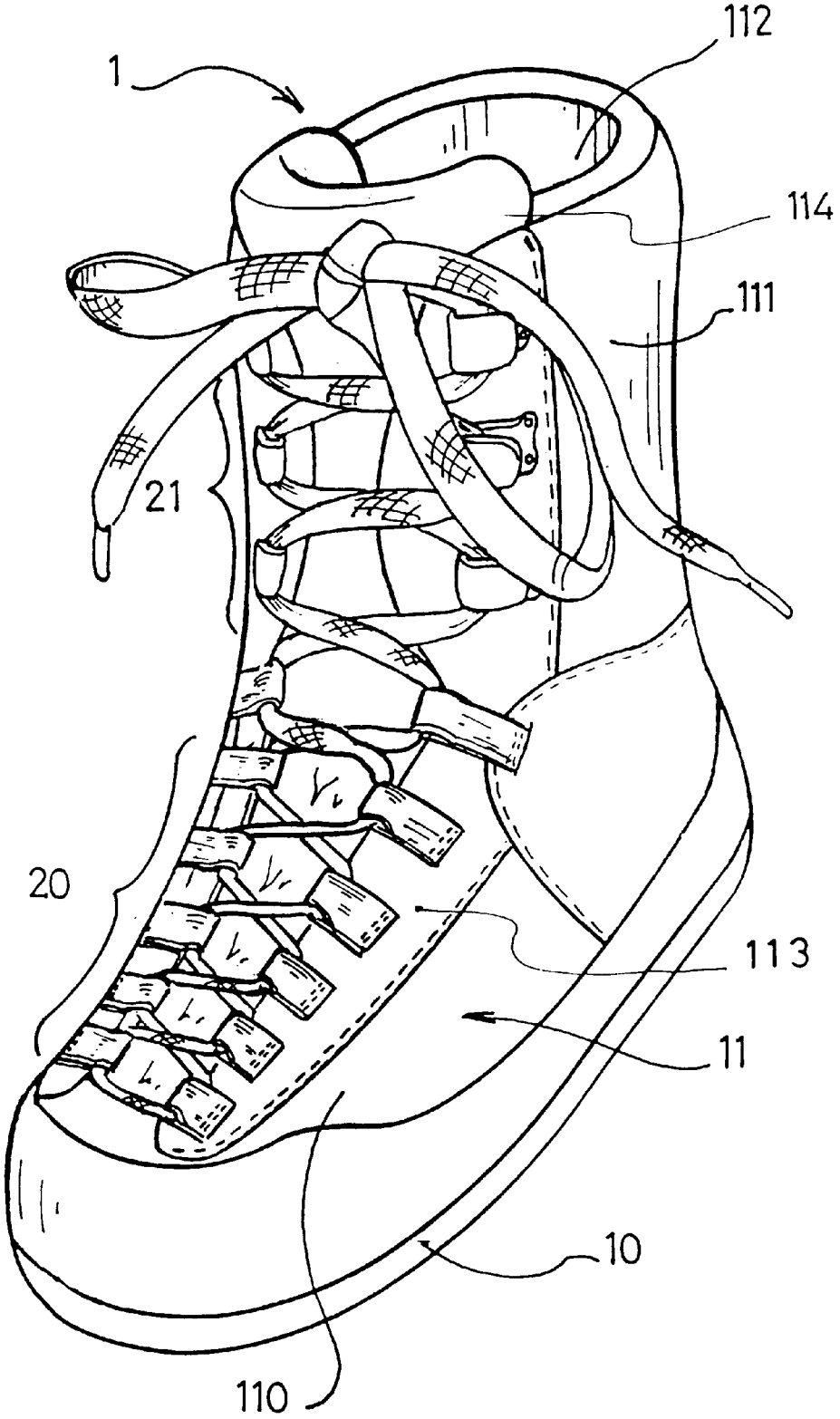
FIG. 2 is a view that is similar to FIG. 1 once the tightening of the boot is completely finished.
Figure 3:
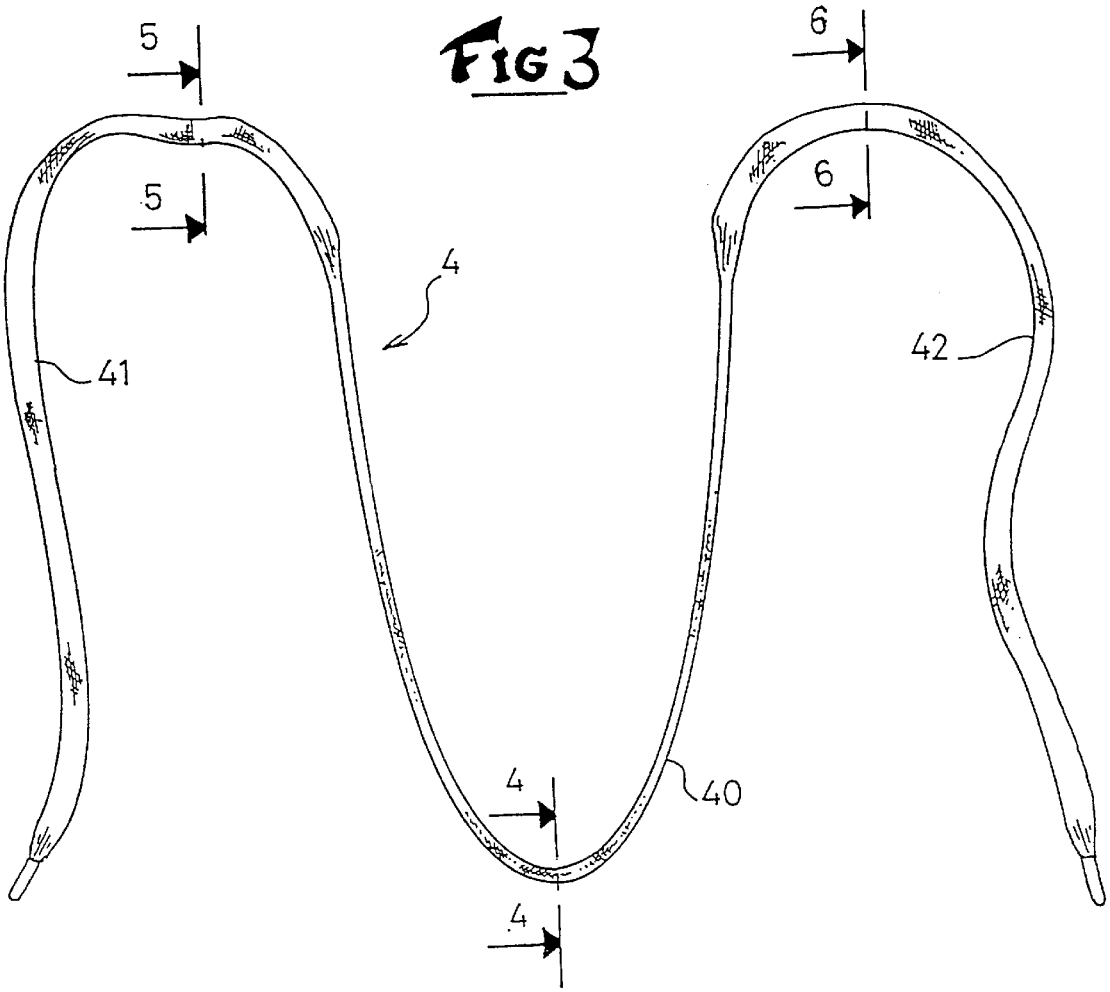
FIG. 3 is a general view of a lace according to the invention.
Figures 4, 5, 6:
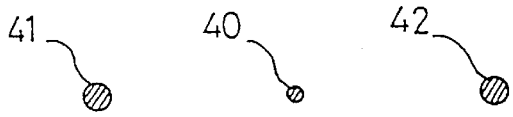
FIG. 4 is a sectional view taken along line 4—4 of FIG. 3.
FIG. 5 is a sectional view taken along line 5—5 of FIG. 3.
FIG. 6 is a sectional view taken along line 6—6 of FIG. 3.

FIG. 2 shows boot 1 when the lacing operation is completely finished, with the frontal portion of the upper and with the ascending portion of the upper in a tightened configuration. By virtue of the lace according to the invention which offers variable contact surface portions with the return elements, it is possible to obtain a tightening that is relatively differentiated between the frontal portion 110 and the ascending portion 111 of the upper. Tightening is therefore more uniform in each part and better adapted to requirements in terms of retention of the foot, feeling, comfort, etc.

FIGS. 3, 4, 5, and 6 represent an example of the lace according to the invention.

The central portion 40 has a smaller section than the section of the ends 40, 41. The term "section" designates the surface represented by the section of the lace in a state of no tension.

Preferably, portion 40 has a substantially circular periphery in order to encourage sliding, regardless of the twisting of a portion of the lace.

As regards the end portions 41, 42, these may have a circular or non-circular periphery.

Advantageously, the lace is obtained all in one piece from a braid of threads. The central portion is braided more tightly than the end portions, that are braided more loosely. In other words, the density of the thread is greater in portion 40 than in the other portions. Consequently, this portion is stiffer and has less stretching capacity. This improves its tightening efficiency in a circuit of the "closed" loop type.

The braiding is made in a continuous manner via traditional braiding techniques, using braiding machines of the circular type, whose parameters have been modified during the braiding process so as to obtain the various characteristic portions.

The lace can be made from flexible threads of different types, such as from natural or synthetic materials. It can be reinforced with a metallic core or comprise metallic threads that are mixed in with the flexible threads. The present invention is not limited to the embodiments described hereinabove, and includes all equivalents falling within the scope of the claims enumerated hereinafter.

The instant application is based upon the French priority patent application No. 96.10699 filed on Aug. 29, 1996, the disclosure of which is hereby expressly incorporated by reference thereto, and the priority of which is hereby claimed under 35 USC 119.

What is claimed is:

1. A lace for sports boots having an ascending upper, the lace comprising:

a central portion and two end portions attached to opposite ends of the central portion, the central portion and the two end portions being made all in one piece from a continuous braid of threads;

the central portion and each of the end portions have circular cross sections, the cross section of the central portion has a smaller diameter than the cross sections of each of the end portions.

2. A lace for sports boots according to claim 1, wherein:

the central portion is braided more tightly than the end portions, the ends portions being braided more loosely.

3. A sports boot comprising:

a sole and an upper attached to the sole;

the upper comprising a frontal portion and an ascending upper portion, the upper portion extending the frontal portion upwardly to cover the lower part of the leg of a user;

the upper having an opening for the passage of a foot, the opening being demarcated by two lateral frontal quarters for the frontal portion, and two lateral upper quarters for the ascending portion of the upper;

the upper further comprising:

a first series of return elements distributed across from each other along each lateral frontal quarter in the frontal portion of the upper; and a second series of return elements, distributed across from each other along the lateral upper quarter in the ascending portion of the upper;

a lace extending from the frontal portion up through to the top of the ascending portion of the upper, the lace comprising a first portion that cooperates with the first series of return elements acting by tightening along the frontal quarters and two second end portions that cooperate with the second series of return elements acting by tightening along the upper quarters, the end portions ending in two respective free end parts;

the first portion of the lace having a smaller cross section than a cross section of each the two second end portions of the lace.

4. A sports boot according to claim 3, wherein:

the first portion and each of the second end portions of the lace have circular cross sections, the cross section of the first portion has a smaller diameter than the cross sections of each of the second end portions.

5. A sports boot according to claim 3, wherein:

the lace is made all in one piece from a braid of threads, the first portion being braided more tightly than the second end portions, the second end portions being braided more loosely.

6. A sports boot according to claim 4, wherein:

the lace is made all in one piece from a braid of threads, the first portion being braided more tightly than the second end portions, the second end portions being braided more loosely.

7. A sports boot according to claim 3, wherein:

the frontal portion of the upper has a loosened configuration and a tightened configuration, whereby the lateral frontal quarters are closer together in the tightened configuration than in the loosened configuration;

the first series of return elements defines a first connection circuit and the second series of return elements defines a second connection circuit, the first and second connection circuits have respective lengths; and the first portion of the lace has a length at least equal to the length of the first connection circuit in the loosened configuration of the frontal portion of the upper.

8. A sports boot according to claim 4, wherein:

the frontal portion of the upper has a loosened configuration and a tightened configuration, whereby the lateral frontal quarters are closer together in the tightened configuration than in the loosened configuration;

the first series of return elements defines a first connection circuit and the second series of return elements defines a second connection circuit, the first and second connection circuits have respective lengths; and the first portion of the lace has a length at least equal to the length of the first connection circuit in the loosened configuration of the frontal portion of the upper.

9. A sports boot according to claim 5, wherein:

the frontal portion of the upper has a loosened configuration and a tightened configuration, whereby the lateral frontal quarters are closer together in the tightened configuration than in the loosened configuration;

the first series of return elements defines a first connection circuit and the second series of return elements defines a second connection circuit, the first and second connection circuits have respective lengths; and the first portion of the lace has a length at least equal to the length of the first connection circuit in the loosened configuration of the frontal portion of the upper.

10. A sports boot according to claim 3, wherein:

the first series of return elements are constituted by closed loops.

11. A sports boot according to claim 4, wherein:

the first series of return elements are constituted by closed loops.

12. A sports boot according to claim 5, wherein:

the first series of return elements are constituted by closed loops.

13. A sports boot according to claim 6, wherein:

the first series of return elements are constituted by closed loops.

14. A sports boot according to claim 7, wherein:

the first series of return elements are constituted by closed loops.

15. A sports boot according to claim 8, wherein:

the first series of return elements are constituted by closed loops.

16. A sports boot according to claim 9, wherein:

the first series of return elements are constituted by closed loops.

17. A sports boot according to claim 10, wherein:

the closed loops are formed by folded straps, the folded straps having ends connected to the upper.

18. A sports boot according to claim 3, wherein:

the second series of return elements are constituted by open hooks.

19. A sports boot according to claim 4, wherein:

the second series of return elements are constituted by open hooks.

20. A sports boot according to claim 5, wherein:

the second series of return elements are constituted by open hooks.

21. A sports boot according to claim 6, wherein:

the second series of return elements are constituted by open hooks.

22. A sports boot according to claim 7, wherein:

the second series of return elements are constituted by open hooks.

23. A sports boot according to claim 8, wherein:

the second series of return elements are constituted by open hooks.

24. A sports boot according to claim 9, wherein:

the second series of return elements are constituted by open hooks.

25. A sports boot according to claim 3, wherein:

the second series of return elements are constituted by open hooks.

26. A sports boot according to claim 4, wherein:

the second series of return elements are constituted by open hooks.

27. A sports boot according to claim 5, wherein:

the second series of return elements are constituted by open hooks.

28. A sports boot according to claim 6, wherein:

the second series of return elements are constituted by open hooks.

29. A sports boot according to claim 7, wherein:

the second series of return elements are constituted by open hooks.

30. A sports boot according to claim 8, wherein:

the second series of return elements are constituted by open hooks.

31. A sports boot according to claim 9, wherein:

the second series of return elements are constituted by open hooks.

32. A sport boot according to claim 3, wherein:

the upper further comprises a third series of return elements between the first series of return elements and the second series of return elements, the third series of return elements having downwardly extending surfaces for engagement with the lace.

33. A sport boot according to claim 3, wherein:

the upper further comprises a third series of return elements between the first series of return elements and the second series of return elements, the third series of return elements comprise means for retaining a tightening tension of the frontal portion of the upper before tightening of the upper portion of the upper is undertaken.

34. A sports boot according to claim 3, wherein:

the sports boot comprises a boot for a gliding sport.

35. A sports boot according to claim 3, wherein:

the sports boot comprises a snowboarding boot.

36. A sports boot comprising:

a sole and an upper attached to the sole;

the upper comprising a frontal portion and an ascending upper portion, the upper portion extending the frontal portion upwardly to cover the lower part of the leg of a user;

the upper having an opening for the passage of a foot, the opening being demarcated by two lateral frontal quarters for the frontal portion, two lateral upper quarters for the ascending portion of the upper, and a tongue between the lateral frontal quarters and between the lateral upper quarters;

the frontal portion of the upper has a loosened configuration and a tightened configuration, whereby the lateral frontal quarters are closer together in the tightened configuration than in the loosened configuration;

the upper further comprising:

a first series of return elements distributed across from each other along each lateral frontal quarter in the frontal portion of the upper, the first series of return elements defining a first connection circuit;

a second series of return elements distributed across from each other along the lateral upper quarter in the ascending portion of the upper, the second series of return elements defining a second connection circuit;

a lace extending through pluralities of the first series of return elements and pluralities of the second series of return elements, the lace comprising a central portion that cooperates with the first series of return elements and opposite end portions that cooperate with the second series of return elements, the end portions ending in two respective free end parts;

the central portion of the lace having an area of smaller cross section than areas of cross section of each the opposite end portions of the lace;

the central portion of the lace having a length at least equal to a length of the first connection circuit in the loosened configuration of the frontal portion of the upper.

37. A sports boot according to claim 36, wherein:

the first series of return elements are constituted by closed loops and the second series of return elements are constituted by open hooks.

* * * * *